US008875770B1

(12) United States Patent
Martin et al.

(10) Patent No.: US 8,875,770 B1
(45) Date of Patent: Nov. 4, 2014

(54) HANGER FOR SHOWER CURTAIN HAVING SAME-ORIENTATION DOUBLE HOOKS

(71) Applicant: Kenney Manufacturing Company, Warwick, RI (US)

(72) Inventors: Carolyn Martin, Providence, RI (US); Jeffrey Klowan, Woonsocket, RI (US)

(73) Assignee: Kenney Manufacturing Co., Warwick, RI (US)

( * ) Notice: Subject to any disclaimer, the term of this patent is extended or adjusted under 35 U.S.C. 154(b) by 0 days.

(21) Appl. No.: 13/667,974

(22) Filed: Nov. 2, 2012

Related U.S. Application Data

(60) Provisional application No. 61/554,833, filed on Nov. 2, 2011.

(51) Int. Cl.
*A47H 1/00* (2006.01)
*A47H 23/00* (2006.01)
*A47H 13/04* (2006.01)

(52) U.S. Cl.
CPC ..... *A47H 13/04* (2013.01); *A47H 23/00* (2013.01)
USPC ..... 160/124; 16/87.2

(58) Field of Classification Search
USPC ..... 160/124, 348, DIG. 6; 16/87.2, 87.8, 16/94 D, 96 D; 4/458, 608; 211/119, 124; 24/716
See application file for complete search history.

(56) References Cited

U.S. PATENT DOCUMENTS

| | | | | | |
|---|---|---|---|---|---|
| 1,109,608 | A | * | 9/1914 | Ashmore | 16/87.8 |
| 1,143,100 | A | * | 6/1915 | Brewington | 24/360 |
| 1,451,754 | A | * | 4/1923 | Angevine | 16/87.8 |
| 1,478,820 | A | * | 12/1923 | Dwyer | 160/348 |
| 1,528,111 | A | * | 3/1925 | Jensch | 24/360 |
| 1,857,293 | A | | 1/1931 | Vroom | |
| 1,979,674 | A | * | 11/1934 | Cowan | 160/387 |
| 2,634,031 | A | * | 4/1953 | Klein | 223/88 |
| 2,649,208 | A | * | 8/1953 | Wilson | 211/119 |
| 3,054,538 | A | * | 9/1962 | Rubin et al. | 223/88 |
| 3,419,239 | A | * | 12/1968 | Ginther | 248/215 |
| 3,592,343 | A | * | 7/1971 | Swett et al. | 211/123 |
| 3,762,571 | A | * | 10/1973 | Kamps | 211/85.3 |
| 3,887,079 | A | * | 6/1975 | Crew | 211/118 |
| 3,945,500 | A | * | 3/1976 | Meckstroth | 211/113 |
| 4,136,784 | A | * | 1/1979 | Knobel et al. | 211/119 |
| 5,586,375 | A | | 12/1996 | Cooperman | |
| D560,924 | S | | 2/2008 | Walker | |
| D591,522 | S | | 5/2009 | Barrese | |
| 2007/0050904 | A1 | * | 3/2007 | Harwanko | 4/558 |
| 2007/0261330 | A1 | * | 11/2007 | Liu | 52/235 |
| 2007/0277355 | A1 | * | 12/2007 | Richardson | 24/716 |

* cited by examiner

*Primary Examiner* — David Purol
(74) *Attorney, Agent, or Firm* — C. Nessler

(57) ABSTRACT

A hanger for suspending a shower curtain and a spaced apart liner from a shower bar has a first hook for the curtain and a second hook for the liner, and the mouths or openings of both hooks face in the same direction, preferably toward the inside of the shower enclosure. A decorative medallion is preferably affixed to the outer side of the hanger and the placement and dimension thereof are sufficient to block from view of a person outside the shower the opening at the top of the curtain, by which means the curtain is hung from the outside hook of the hanger.

15 Claims, 5 Drawing Sheets

HANGER FOR SHOWER CURTAIN HAVING SAME-ORIENTATION DOUBLE HOOKS

This application claims benefit of provisional patent application Ser. No. 61/554,833 filed on Nov. 22, 2011.

TECHNICAL FIELD

The present invention relates to hangers for shower curtains, in particular to hangers capable of simultaneously supporting a shower curtain and a spaced apart liner.

BACKGROUND

It is well known to suspend a shower curtain made of sheet material by engaging it with a multiplicity of hangers, also referred to as hooks, which wrap around a horizontal rod or bar running across the opening to a shower enclosure. The hangers are movable along the length of the rod, so the user can slide the curtain horizontally, for access to the enclosure and for bringing the edges of the curtain close to the sides of the enclosure to prevent water from splashing out of the enclosure.

It is also well known to have a liner associated with a shower curtain. A liner is a sheet of material which is placed inboard of the primary shower curtain so that it hangs in parallel with the curtain. Often a liner is the water shedding part of the assembly and the curtain presents a decorative appearance. A liner may be removed and separately cleaned or replaced over time.

Curtains and liners ordinarily have a series of spaced apart openings along their upper ends, so the openings can be engaged with the ends of a multiplicity of hangers positioned on a curtain rod. When a prior art hanger comprises a single hook, a substantially sized decorative medallion can be placed on the side of the hanger which is opposite the hook end, for appearance and in part to conceal the opening in the curtain. See for instance Barrese U.S. Pat. No. D591,522 and Snell U.S. Pat. No. D505,315. As shown in the patents, a typical single hook hanger commonly has a simple unsymmetrical S shape. Thus, in use, the larger end of the S loops over the curtain rod. This larger end is referred to as the loop in the description which follows. The other smaller end of the S is engaged by the upper edge of the shower curtain. In the description which follows, the smaller end of the hanger is referred to as the hook, and the whole of the item is called the hanger.

Certain kinds of double hook hangers for suspending the combination of a liner and a curtain are known. The hooks face in opposing directions: during use one hook has a mouth opening facing into the shower enclosure, and the other hook mouth faces outwardly. Barrese U.S. Pat. Publication 2006/0042002 shows such a wire-formed hanger. See also Harwanko U.S. Pat. Publication 2007/00509004, Michaelson U.S. Pat. No. D459,201 and Kim U.S. Pat. No. D630,498 for similar opposing-direction double hook hangers.

Shower curtain hangers have most often been made from steel wire, but may be made of plastic material. As shown in the foregoing publications, the tips of hooks, to which the user might be exposed during use, often have enlarged ends which serve to blunt them. For instance, a small knob may be attached to the terminal free end of a hook for functional as well as decorative purpose.

It will be appreciated by reference to patents, and by thinking about it, that for the familiar single hook hangers the size of a decorative medallion is not limited. However, in contrast, in double hook hangers that typify the prior art, exemplified by the references cited above, there is no decorative medallion and no evident way of having one, since the outward face of the hanger is the terminal end of a hook, the mouth of which hook faces a person outside the shower enclosure. While the terminal ends of the outside hooks have small knobs, the size of such must be limited since the hole or eyelet of a liner or curtain has to be passed over the knob when the liner or curtain is installed. Thus, it would be desirable to have a double hook hanger which enabled larger decorative features like those which have been associated with single hook hangers.

SUMMARY

An object of the invention is to provide a hanger for suspending a combination of shower curtain and liner, or any two other sheets, from a shower rod, in a way which stably holds them parallel to each other and spaced apart from each other. A further object is to provide the foregoing means in combination with decorative elements which functionally limit the visibility of the openings at the tops of the sheets by which the sheets are engaged with the hanger.

In accord with the invention, an embodiment of hanger comprises a loop which is shaped to engage a shower rod, a first hook and a second hook that are connected to the loop, where both hooks face in the same direction. With reference to a shower enclosure having an inside region, a hanger embodiment comprises a first or outside hook which has a mouth which faces toward the vertical centerline of the loop and toward the inside of the enclosure, and a second or inside hook which has a mouth which faces away from the vertical centerline, the mouth also facing in the inside direction. The vertical outside portion the first hook transitions to a hanger body portion that runs inwardly toward the centerline of the loop and whole of the hanger, across the vertical center line of the cradle of the outside hook, there to define part of a throat which is at the bottom of the loop.

In embodiments of the invention, the hanger is shaped as just stated and a medallion is permanently or removably attached to a vertical running portion of the outside hook. Preferably, the dimensions of the hanger and the dimensions of the medallion are sufficient to conceal from the view of a person standing outside the shower enclosure the opening in a shower curtain when it is suspended from the outside hook, to present a pleasing appearance.

In embodiments of the invention, the nadirs of the cradles of the two hooks of the double hook hangers are spaced apart differently from the vertical centerline of the hanger loop. The nadirs are the points to which, in use, a curtain or liner tends to migrate due to the effect of gravity. Preferably, the nadir of the first or outside hook, which usually carries the curtain and optionally has a medallion, is further from the vertical centerline of the loop than is the nadir of the second or inside hook. Thus, the weight of the liner on the second inside hook will have comparatively lesser tendency in making the hanger rotate about the curtain rod, compared to the effect of a curtain suspended from the first outside hook.

The hanger of the invention provides a useful way of hanging a curtain and liner while presenting a pleasing appearance, whether the medallion is present or not. The hanger may be economically manufactured. The foregoing and other features and advantages of the invention will be appreciated further from the following description.

DESCRIPTION

This application is related to provisional patent application Ser. No. 61/554,833 filed on Nov. 2, 2011 and to design patent application Ser. No. 29/405,486, entitled "Shower Curtain Hanger Having Same Orientation Double Hook," filed on Nov. 2, 2011 by the inventors herein and having common ownership, the disclosures of both of which are hereby incorporated by reference. The present invention is described in terms of a preferred embodiment made of metal components; the invention may be alternatively constructed of plastic components or a combination of metal and plastic parts. The following description focuses on single hangers, but as should be well appreciated, the hangers of the present invention will be commonly used as multiplicities of hooks, spaced apart along the length of a shower rod.

Figure 1:
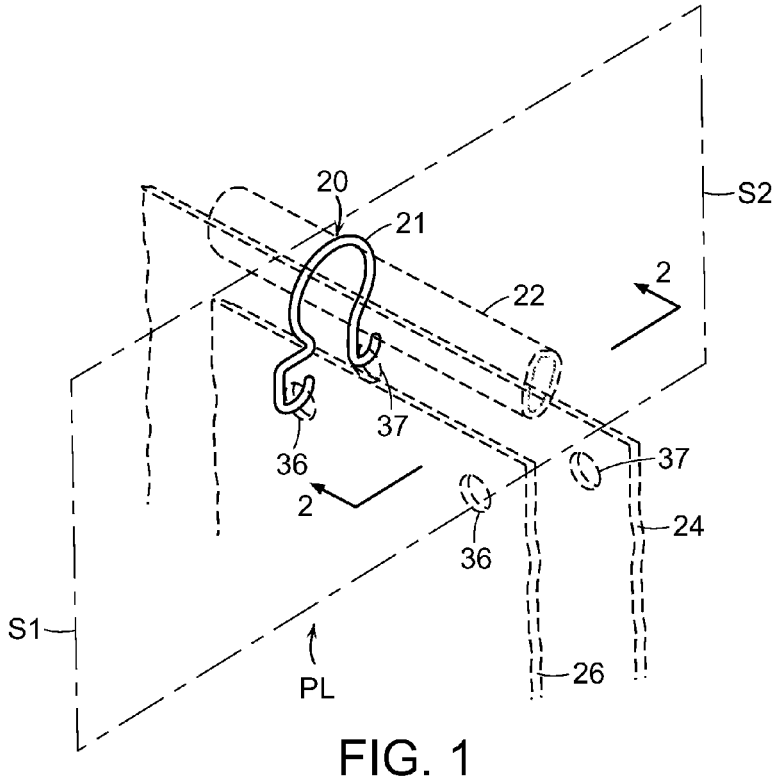
FIG. 1 is a perspective view of a shower hanger, showing in phantom how it is supported on a curtain rod and how a curtain and a liner are suspended from each of the two hooks of the hanger.
Figure 2:
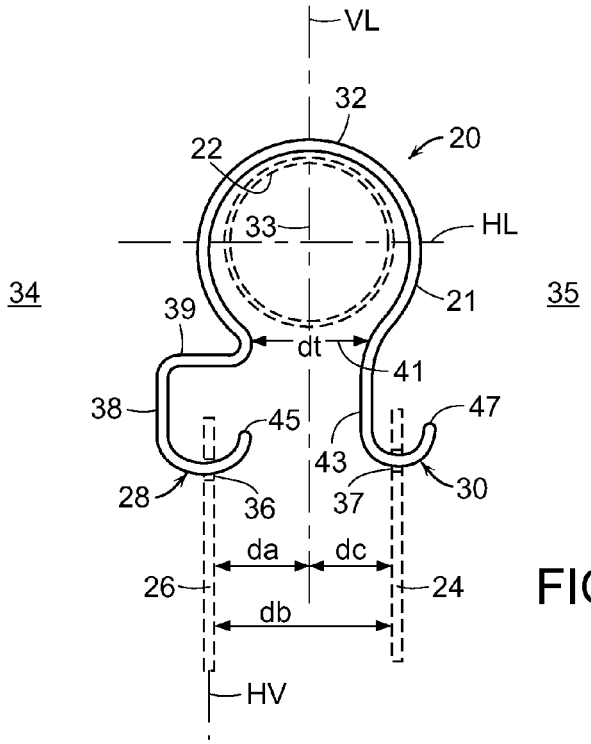
FIG. 2 is an end view of the hanger of FIG. 1.
Figure 12:
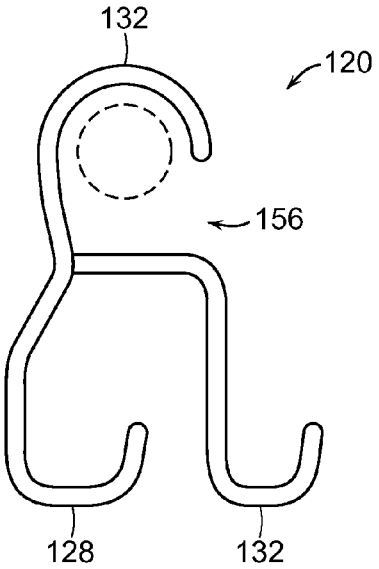
FIG. 12 shows a double hook hanger with a loop for engaging a shower rod, where the loop has a mouth or opening.

FIG. 1 is a perspective view of hanger 20, an embodiment of the present invention useful for supporting a shower curtain 26 and a liner 24, shown in phantom. FIG. 2 shows hanger 20 in end view. The hanger, which is preferably made of steel wire, is pictured as it is mounted during use on a shower rod 22, shown in phantom. Typically the rod 20 will span the opening of a shower or bath tub enclosure (not shown). A shower curtain 26 is typically made of fabric such as sheet of plastic or other material and presents to the space 34 which is outside the enclosure. See FIG. 2. A liner 24, also typically made of fabric such as a sheet of plastic or other material, lies inwardly from the curtain and presents to the space 35 which is within the enclosure. The liner and curtain respectively have a multiplicity of spaced apart openings 36, 37 at their respective upper edges (which may or may not comprise grommets); they are engaged with the hooks 28, 30 of the hanger 20. While in connection with this and other embodiments, a liner may be said to hang from on one hook of the hanger and a curtain is said to hang from the other hook, in the generality of the invention, in use of the hanger there are two separate sheets, whether they be a liner and a curtain. Exemplary hanger 20 has a wire form body 21 or primary structure which lies in a plane PL as illustrated in FIG. 1. The hanger has a first side, also called the outer side, which faces in the plane direction S1, in FIG. 1, and toward space 34 in FIG. 2. The hanger has a second side which faces in direction S2 in FIG. 1. This second side is also called the inner side of the hanger because it faces toward inside space 35 during typical use of the hanger. Although the hanger has a thickness it may be said to substantially lie in the plane PL. Similarly, the hanger may comprise knobs at the ends of the hooks; and the alignment and spatial relationship of those parts, as illustrated herein, is within the scope of all the parts being substantially in a plane PL. The hanger structure which is illustrated in FIGS. 1 and 2 is called the primary structure or the body of the hanger. The medallion which is described below is secondary structure With particular reference to FIGS. 1, 2 and 2A, hanger 20 has an upper portion, called here loop 32 (alternatively bail 32). The loop 32 of hanger 20 preferably has the shape of a part of a circle or near-circle. (In another embodiment, as shown in FIG. 12, the loop 132 has an opening 156, and thus is hook-like.) Loop 32 has a horizontal centerline which is parallel to the centerline of a rod upon which it is shaped to rest, and thus is perpendicular to the plane PL. The nominal diameter of loop 32 is larger than the diameter of the rod 22 upon which it is shaped to hang and thus during use the center 33 of the loop and the horizontal cross sectional axis HL of the loop is lower than the center 35 of the rod 22. The loop 32 preferably has an opening or throat 41 with a dimension dt that is somewhat smaller than the diameter of the rod 22. For example, for a typical one inch diameter rod, the throat diameter may be about 0.6 inches. Optionally, dimension dt may be equal to or somewhat larger than the diameter of the rod. The total height of a typical hanger is about 2.4 inches.

The lower end of hanger 20 comprises two hook portions 28, 30. The hook 28 is called the outside hook or first hook; and hook 30 is called the inside hook or second hook. Outside and inside, when used herein, refer to respectively the left and right sides of the hanger as it is shown in FIG. 2. The terms are used for convenience of description here and are not limiting with respect to which way a hanger faces during use in a shower enclosure. The inside and outside hooks have mouths, that is, openings that enable sheet to be engaged with and hung from the cradle of the hook. The mouths face in the same direction, i.e., typically inwardly toward the interior of the shower enclosure during use. The path of each hook descends downwardly from a respective terminal free end 45, 47 (which terminal free end in part with the respective other portion 38/39, 43 of the hook defines the mouth or opening of the hook), and then curves upwardly to form a nominal C-shape cradle (portions 29A and 31A in FIG. 3) having a nadir, or vertically lowermost point. During use, a curtain or liner (i.e., generally, a sheet of material) is supported on the cradle, and gravity will tend to cause a curtain or liner sheet to migrate to the nadir.

The nadirs of the left and right hook of exemplary hanger 20 are spaced apart a distance db as shown in FIG. 2. The horizontal dimension da, the distance between the vertical centerline VL of the loop 32 and the nadir of first hook 28, is greater than the dimension dc, the distance between the centerline VL and the nadir of second hook 30. Alternatively stated, the dimension da is more than half the dimension of the distance db between the two nadirs of the hooks 28, 30. In embodiments of the invention, the dimension da may be 120 to 230 percent of the dimension db.

The asymmetry in dimensions da, dc means that a sheet such as liner 24 hanging from hook 30 will have comparatively lesser effect in causing rotation of the hanger than will an equal weight sheet such as curtain 26 hanging from hook 28. Thus, as a corollary, if the liner on hook 30 is heavier than the curtain on hook 28, either inherently or because of water soaking, it will have reduced propensity of causing the hanger to rotate (clockwise in FIG. 2) about the shower rod 22. Such unwanted rotation would make poorer the visual presentation of the hanger and curtain combination to a person standing outside the shower enclosure. In particular, the rotation could expose the holes at the upper end of the curtain when the hanger has a decorative medallion, as described below. In an alternative hanger embodiment, the nadirs are symmetrically spaced relative to the centerline VL of the loop 42 and thus the dimension da from vertical center line VL to the nadir of hook 28 (defined by vertical axis HV in FIG. 2) is half the dimension db.

It is desirable that a hanger 20 be oriented during use as it is shown in FIG. 2, i.e., where the horizontal spacing between the curtain and liner (and the associated nadirs) is maximized. In the embodiment shown that means the nadirs of the two hooks have about the same elevation. In another embodiment, not shown, by design the nadir of one hook may be at a higher elevation than the nadir of the other hook. If there is any rotation or cocking of the hanger from the desired even orientation such as shown in FIG. 2, the curtain and liner will become more closely spaced, even to the point of touching. And of course, there will be a corresponding change in the elevations of the curtain and liner relative to each other, one lifting up and the other lowering down.

When the second of inside hook 30 is conceived as a sub-portion of the hanger 20, it may be characterized as having a J shape, the shorter leg of which J faces away from the centerline VL and in the planar direction S2 (FIG. 1). In another way of putting it, the mouth of the J shape hook faces in the direction S2, i.e., in the inside direction.

The hook 28 of hanger 20 has a more complex shape. It also can be conceived as comprising a J shape, with lower part of the J being a shallow nominal C shape cradle, the nadir of which lies along the vertical line HV shown in FIG. 2 and FIG. 11, and referred to again below. The shorter leg of the J shape, which terminates at end 45, faces toward the centerline VL and in planar direction S2, i.e., in the inside direction. Hook 28 has a nominally vertical portion 38, the long leg of the J shape, which also comprises part of the connection of the hook to the loop. Portion 39 of the hanger extends laterally, or inwardly, as a continuation of the hook long leg 38 in the direction of the centerline VL and toward throat 41 of the loop 32. In the embodiment of FIG. 2 the portion 39 is more or less horizontal, rising only slightly in its approach to throat 41. The terminal end 45 of hook 28 is spaced apart from portion 39 a sufficient distance (shown as distance 43 in FIG. 3) to enable a user to slip a curtain onto the hook.

The hanger of the present invention is advantageous over the prior art in that the terminal end of the hanger outside hook is concealed in the space between the curtain and the liner. It is thus less susceptible to inadvertent engagement with a body part or cloth, etc., and thus a knob at the end might be omitted. And the hanger presents simply to the person outside the shower enclosure as a vertical rod, rather than the terminal end of a hook, when such simplicity and niceness is desired.

The further utility of having the arrangement of hanger portions 38, 39 which is focused on herein, and other variations of combined vertical-turning portion 38 and laterally extending portion 39, is that it enables attachment of a decorative element, a medallion, in ways which are described just below.

Figure 3:
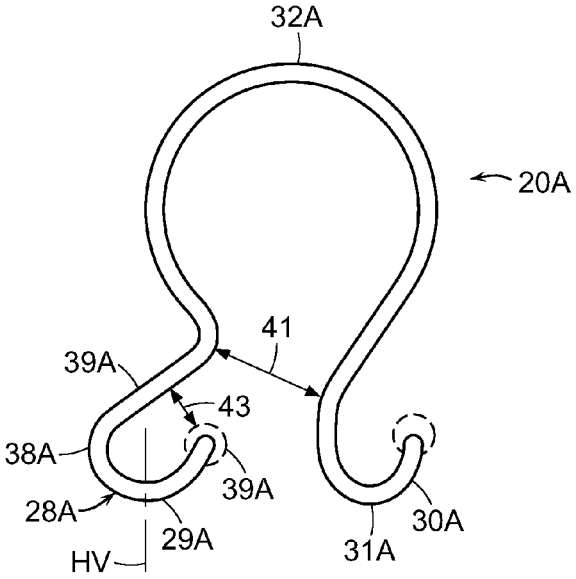
FIG. 3 is an end view of an alternate embodiment hanger much like that of FIG. 2, but having a different shape outside hook. Spherical knobs at the terminal ends of the hanger are shown in phantom.

FIG. 3 shows alternative embodiment hanger 20A. (In FIG. 3 and other Figures are suffix-numbered elements that correspond with the numbered elements of hanger 20; similarly, as to three digit numbers with prefix 1- or 2-.) The outside hook 28A has a rather small vertically extending portion 38A that transitions into the laterally extending portion 39A that slopes substantially upwardly as it extends to vicinity of throat 41.

In the generality of this aspect of the invention, when seen in end view (as in FIG. 2), a hanger has a structure, or body, comprising a first (outer hook) having mouth which faces the centerline of the hanger, a cradle, and an outside portion, spaced apart from the centerline of the hanger loop, which extends upwardly (vertically) from the cradle for a distance; the body then runs inwardly (laterally) toward the centerline, optionally inwardly and upwardly, across an imaginary vertical extension line HV which passes through of the nadir of the cradle of the first/outer hook, so the body path approaches toward the centerline of the hanger and the throat of the loop. The body structure defines part of the throat and continues on to form the loop which is shaped to engage a shower rod and then to form the opposing on inner side the throat of the loop; and the body then continues to form the second/inside hook having a mouth facing in the same direction as the mouth of the first hook.

Figure 4:
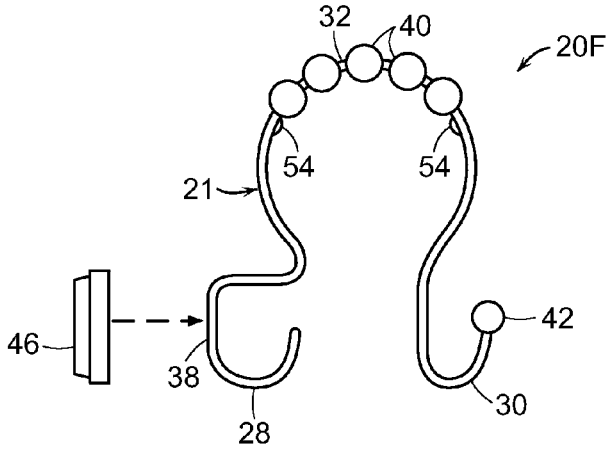
FIG. 4 is an exploded view of the hanger of FIG. 1 with a decorative medallion which attaches to the side of one of the hooks and a spherical knob attached to the terminal end of the other hook; and a plurality of rollers are attached to the top of the hanger.

FIG. 4 shows hanger 20 like that shown in FIG. 2 in combination with some other elements. Preferably, the hanger body 21 is made of nominal 0.09 inch diameter rust-resisting steel wire (e.g., by being plated or inherently by composition). A multiplicity of spherical rollers 40, optionally flat surfaced rollers, is positioned at the top of the loop 32, to better enable the hanger to be moved along the length of a rod 22. The rollers 40 are positioned along an arc of the loop 32 which is centered on the nominal part-circular curve which characterizes the loop 32; preferably the included angle of that arc is about 130 degrees. Tabs 54 resulting from local deformation of the wire body 21 keep the rollers in position.

A spherical section knob 42 which may have an outside diameter of about one-quarter inch is attached to the terminal end of hook 30 for decorative purpose, for blunting the end of the hook 30, and for inhibiting sliding disengagement of a liner from the end of the hook.

A nominal plate-like medallion 46 is shown in FIG. 4 in exploded position; it attaches to the vertical portion 38 of hook 28 as indicated by the dashed arrow. The medallion 46, which may be metal, plastic, ceramic or other substance, may be attached to the hook by mechanical means, or by welding, adhesive, etc. or other known means appropriate to the materials of the medallion 46 and hook 28, which means are generally known in the field of shower hangers and in the field of jewelry decoration as well. In other embodiments of the invention, the medallion 46 may have different shapes and sizes, for instance, it may be a flat disk, an irregular shape, and it may have embossing, sculpting, attachments, etc.

Figure 5:
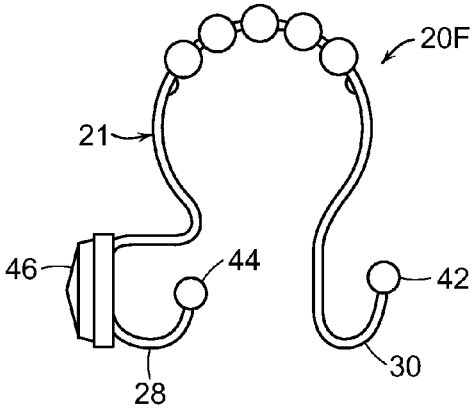
FIG. 5 is an end view like FIG. 4, showing a medallion attached to the left outer side of a hook and a spherical knob attached to the tip of each of the two hooks.
Figure 6:
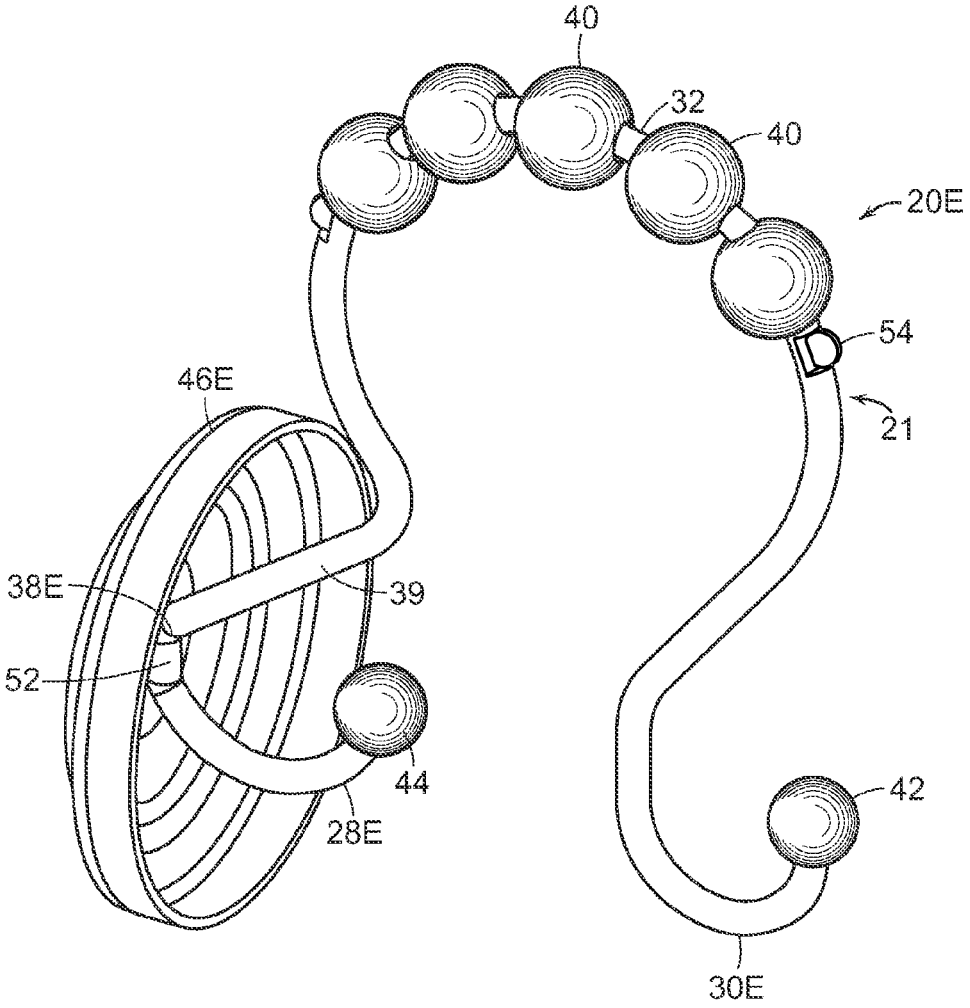
FIG. 6 is a perspective view of a hanger having a hanger comprising rollers, decorative medallion, and knobs on the terminal ends of hooks.
Figure 8:
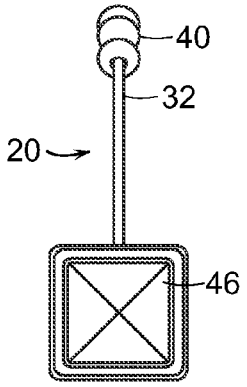
FIG. 8 is a side view of the hanger of FIG. 5.

FIG. 5 shows the hanger 20F of FIG. 4 with medallion 46 attached to the long leg of hook 28. Hook 28 is now shown with a spherical knob 44 fastened to its terminal end, for the same reasons as described for spherical knob 42. FIG. 8 is a side elevation view of the hanger of FIG. 5, illustrating the rectangular shape of the particular medallion FIG. 6 is a perspective view of hanger embodiment 20E in which circular medallion 46E is attached to the vertically-turning portion 38E of hook 28F. The vertical running part of portion 38E is short compared to the hanger of FIG. 2, and the medallion 46E is affixed to it by means of a clip 52.

Figure 7:
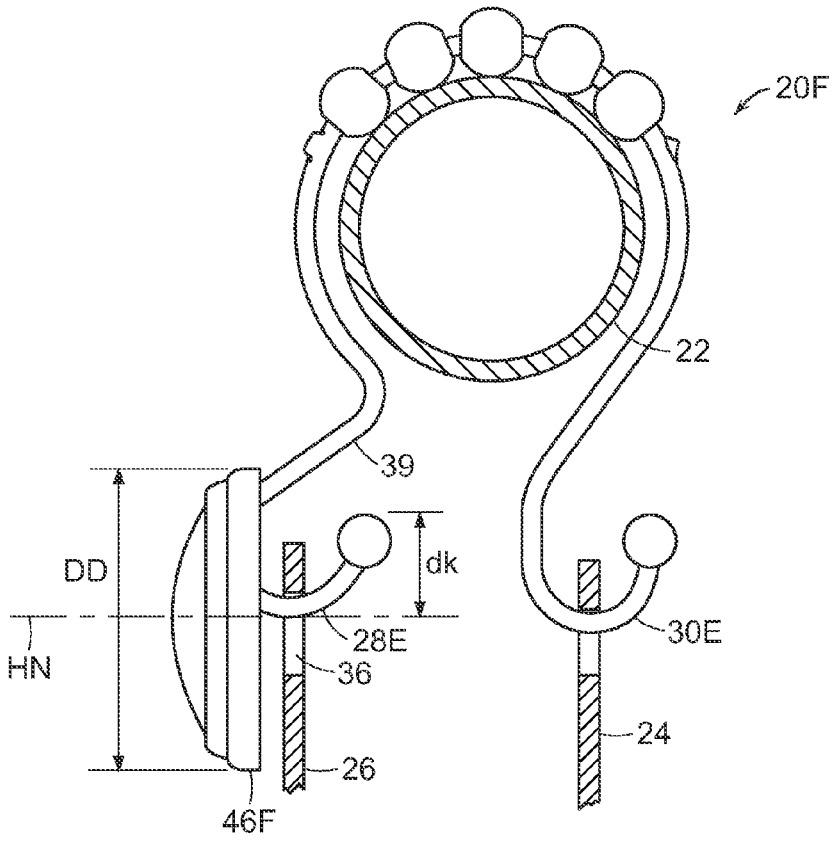
FIG. 7 is a side view of a hanger that is mostly similar to the hanger of FIG. 6.

FIG. 7 is a side view of the hanger 20F that is mostly similar to hanger 20E of FIG. 6, showing also a curtain rod 22, the upper end of a shower curtain 36 which is suspended from the first or outside hook 28E, and a liner 24 suspended from the inside hook 30E. FIG. 7 shows how the medallion 46F has a vertical dimension DD and an attachment location which in combination are sufficient to mostly or entirely hide the opening 36 in the curtain 26, when the curtain is viewed by a person outside the shower enclosure, with the person's eye at about the same elevation as the top of the shower curtain. Thus the hanger presents a more pleasing and finished look to the assembly than in the absence of the particular size and location of medallion. In the embodiment shown, the medallion 46F is circular. In alternative embodiments, the medallion may be rectangular, as shown in FIG. 8, or it may be an irregular shape. In the generality of this aspect of the invention, the combination of the place where the medallion is attached to the hook 28E and or associated connecting portion 38 and the vertical dimension DD of the medallion are such that the lower portion of the medallion covers the opening 36 in the curtain 26. In a particular embodiment, like that shown in FIG. 7, the dimension DD is at least twice the dimension dk of the height of the terminal end of the hook 28E relative to its nadir, and the center of the medallion is at an elevation which is proximate the elevation of the nadir of hook 28E.

In an embodiment of the invention like that shown in FIG. 6 and FIG. 7, the loop may have a nominal inside diameter of about 1½ inches and the medallion may have an about 1¼ inch diameter.

Figure 9:
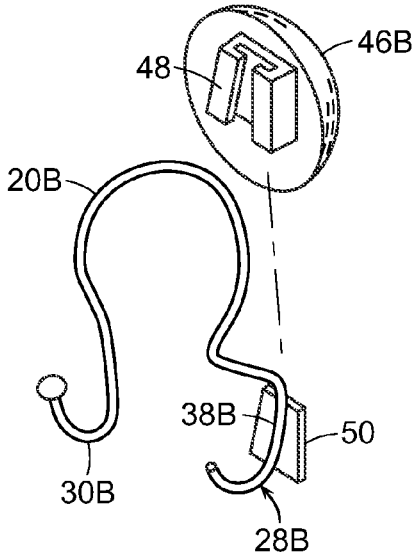
FIG. 9 is an exploded view showing a hanger having a medallion with integral female socket that engages a male wedge on the hanger, so that the decorative medallion may be removed and replaced with another medallion.

FIG. 9 shows a hanger 20B which is much like the hanger 20. Hanger 20B comprises outside hook 28B which has a wedge 50 permanently affixed to the vertical portion 38B of the hook. An exemplary circular decorative medallion 46B, shown in exploded position by means of the dashed line in the Figure, has an attached female fitting 48 shaped for receiving the wedge 50. Thus a user may be provided with, and select for use from, a choice of different design medallions, and has the option of future change or replacement of the medallion.

Figure 10:
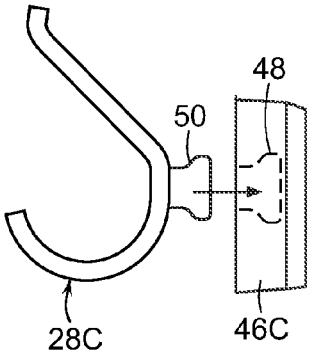
FIG. 10 is a partial view like similar to that of FIG. 9 and shows an alternative embodiment hanger and medallion attachment means.

FIG. 10 shows in fragmentary view an alternative embodiment of means for medallion engagement with a hook. The lower portion of hook 28C is shown. Medallion 46C has a socket 48 in which is received fat-headed pin 50. The medallion is made of resilient plastic or other material, at least in vicinity of the socket. Other pin-to-socket engagement means known in the art may be used. For further details of how a hanger with an interchangeable medallion may be configured see Copperman et al. U.S. Pat. No. 5,586,375, the disclosure of which is hereby incorporated by reference.

Figure 11:
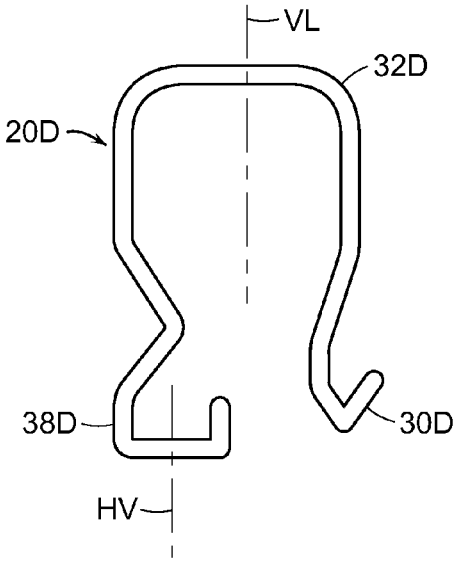
FIG. 11 shows a hanger having part-rectangular loop and hooks.

While rollers at the top of the loop are preferred and knobs at the terminal ends of the wire of the hanger are desirable, the hanger of the essential invention is useful without either. Likewise, with reference to FIG. 2 and FIG. 3, the outer hook of an invention hanger, in particular the portions 38, 38A and 39, 39A may have shapes which vary from those particular shapes which have been pictured thus far. A loop may have other shape than a part-circular shape. As shown in FIG. 11, when a curtain rod is rectangular in cross section, the loop top 32D of the hanger may have a corresponding part-rectangle shape. Hooks may have shapes other than curved cradles, for holding the curtain or liner. For instance, the hooks may have a part nominal-rectangle shape (i.e., a flat cradle section 38D, the center of which shall be taken to be the nadir), or a part vee-shape as for hook 30D, as shown in FIG. 11. When the loop does not comprise a portion of a circle, the center of the loop shall be the center of that circle which has a best fit within the loop.

In other embodiments of the invention, a loop may have an opening so it is hook-like. FIG. 12 shows hanger 120 wherein the loop 132 has an opening 156, to enable engagement with a shower rod. The lower end of the hanger body is bifurcated to define the outside hook 128 and the inside hook 132.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A hanger for vertically suspending two spaced apart fabric sheets having spaced apart openings along the upper edges thereof from a horizontal shower rod running across the opening of a bath shower or bath tub enclosure, the hanger having a body lying substantially in a plane, an in-plane first side, and an opposing in-plane second side, comprising:

a loop, for slidingly engaging a shower rod, the loop having a top, a throat, a central axis running perpendicular to said plane, and a vertical axis in said plane intersecting said central axis;

a first hook on the first side of the hanger, connected to the loop and having a cradle shaped for engaging one of said sheet openings, having a terminal free end defining in part a first hook mouth facing in the direction of the hanger second side; the first hook cradle having a nadir and an associated imaginary vertical axis running parallel to the said loop vertical axis; and, a second hook on the second side of the hanger, connected to the loop and having a cradle shaped for engaging one of said sheet openings, the second hook cradle having a nadir and a terminal free end defining in part a second hook mouth facing in the direction of the hanger second side; wherein said throat of the loop faces downwardly and wherein the portion of said body which comprises the connection between the first hook and the loop runs vertically upwardly from vicinity of said first hook cradle and then laterally inwardly in the direction of said vertical center line to the throat of the loop, crossing the vertical centerline of said first hook cradle.

2. The hanger of claim 1 further comprising a decorative medallion attached to the first hook on the first side of the hanger.

3. The hanger of claim 2 wherein the horizontal centerline of the medallion is proximate the horizontal elevation of the nadir of the first hook.

4. The hanger of claim 2 in combination with a horizontal shower rod and a vertically-suspended shower curtain sheet having an upper edge with a plurality of spaced apart openings; wherein, the shower rod is positioned within the loop of the hanger and runs perpendicular to said plane of the hanger body, to thereby support the hanger; wherein, the hanger first hook is positioned within an opening of said curtain upper edge, to thereby suspend a portion of the curtain from the hanger; and, wherein the medallion has dimensions and location of attachment to the first hook such that the medallion blocks the first opening in the curtain from view of a person looking at the hanger first side when the person's eye is nominally at the same elevation as is said opening in the curtain upper edge.

5. The hanger of claim 1 wherein the loop is part-circular in shape and wherein the first hook is connected to one end of the loop and the second hook is connected to the other end of the loop.

6. The hanger of claim 1 wherein the cradle portions of the hooks are at the same elevation relative to the top of the loop.

7. The hanger of claim 1 wherein the terminal free end of one or both of the first hook and second hook comprises a knob.

8. The hanger of claim 1 wherein the spacing of the vertical axis of the loop and the nadir of the cradle of the first hook is greater than the spacing between the vertical axis of the loop and the nadir of the cradle of the second hook.

9. The hanger of claim 1 wherein the loop has a first side which is continuous and connected to both the first hook and the second hook, and wherein the loop has second side which has a terminal free end defining a mouth in the loop, so the loop is adapted for engaging the shower rod in hook-like fashion.

10. The hanger of claim 1 wherein the loop has a first side connected to the first hook and a second side connected to the second hook, wherein said mouth of the first hook is the space between the terminal free end of the first hook and first side of the loop.

11. The hanger of claim 2 wherein the decorative medallion is removably attached to the first side of the first hook.

12. A hanger for simultaneously vertically suspending a both a shower curtain and a liner from a horizontal shower curtain rod, each curtain and liner having an upper edge with a plurality of spaced apart openings, the hanger having a primary structure lying substantially in a plane, the hanger having an in-plane first side and an opposing in-plane second side, comprising:

a loop, for slidingly engaging a shower rod, the loop having first side with a first side lower end, and a second side with a second side lower end, a throat, a central axis running perpendicular to said plane, and a vertical axis in said plane intersecting said central axis;

a first hook on the first side of the hanger connected to a first side lower end of the loop, having a cradle shaped for engaging one of said shower curtain openings and a terminal end defining in part a first hook mouth facing in the direction of the hanger second side; the first hook cradle having a nadir and an associated vertical axis running parallel to the said loop vertical axis; and, a second hook on the second side of the hanger connected to the second side lower end of the loop, having a cradle shaped for engaging one of said liner openings, the second hook cradle having a nadir and a terminal end defining in part a second hook mouth facing in the direction of the hanger second side;

wherein the hanger portion which connects the loop first side lower end with the first hook runs vertically upwardly from the first hook cradle and then laterally inwardly in the direction of said vertical center line of the loop, thereby crossing said vertical centerline of said first hook cradle; and, a decorative medallion attached to said hanger portion which connects the loop first side lower end to the first hook on the first side of the hanger.

13. The hanger of claim 12 wherein said hanger portion which runs laterally inwardly simultaneously runs upwardly.

14. The hanger of claim 12 wherein the horizontal centerline of the medallion is proximate the horizontal elevation of the nadir of the first hook.

15. The hanger of claim 12 wherein the terminal end of one or both of the first hook and second hook comprises a knob.

* * * * *